US009265356B2

(12) United States Patent
Glazman

(10) Patent No.: US 9,265,356 B2
(45) Date of Patent: Feb. 23, 2016

(54) APPARATUS FOR CARING FOR INFANTS

(71) Applicant: Mark Glazman, Columbus, OH (US)

(72) Inventor: Mark Glazman, Columbus, OH (US)

( * ) Notice: Subject to any disclaimer, the term of this patent is extended or adjusted under 35 U.S.C. 154(b) by 0 days.

(21) Appl. No.: 14/164,366

(22) Filed: Jan. 27, 2014

(65) Prior Publication Data

US 2014/0208511 A1 Jul. 31, 2014

Related U.S. Application Data

(60) Provisional application No. 61/757,449, filed on Jan. 28, 2013.

(51) Int. Cl.
*A47D 9/00* (2006.01)
*A47C 31/00* (2006.01)
*A47D 13/10* (2006.01)

(52) U.S. Cl.
CPC ..... *A47D 9/00* (2013.01); *A47C 31/007* (2013.01); *A47D 13/107* (2013.01)

(58) Field of Classification Search
CPC .. A47C 20/026; A47C 21/044; A47C 31/007; A47D 9/00; A47D 13/107
USPC ..... 5/724–726, 652.1, 652.2, 905, 421, 5/423, 284, 603, 638
See application file for complete search history.

(56) References Cited

U.S. PATENT DOCUMENTS 3,610,716 A 10/1971 Weinberg et al.
4,218,791 A * 8/1980 Itoku ..... 5/284
4,488,547 A 12/1984 Mason
4,602,486 A * 7/1986 Weinstein ..... 62/261
4,939,804 A * 7/1990 Grant ..... 5/423
5,389,037 A * 2/1995 Hale ..... 454/284
5,483,711 A * 1/1996 Hargest et al. ..... 5/725
5,592,704 A * 1/1997 Breese ..... 5/423
5,635,133 A * 6/1997 Glazman ..... 422/24
5,787,534 A 8/1998 Hargest et al.
5,835,840 A * 11/1998 Goswami ..... A61L 9/20 422/186.3
5,842,779 A * 12/1998 Siebert ..... 362/309
6,497,840 B1 * 12/2002 Palestro et al. ..... 422/24
6,546,576 B1 * 4/2003 Lin ..... 5/423
6,752,957 B1 * 6/2004 De Lasa et al. ..... 422/22
6,941,949 B2 9/2005 Amante et al.
6,945,249 B2 9/2005 Griesbach, III et al.
7,404,219 B2 7/2008 Berkey
7,487,646 B2 * 2/2009 Matsushima et al. ..... 62/186
8,122,540 B2 * 2/2012 Ardis ..... 5/423
2008/0279733 A1 * 11/2008 Glazman ..... 422/186.3
2009/0025716 A1 * 1/2009 Glazman ..... 128/201.25
2010/0005588 A1 * 1/2010 Christopher ..... 5/423
2010/0125949 A1 * 5/2010 Stebbing ..... 5/423
2012/0024154 A1 * 2/2012 Augustine et al. ..... 95/273
2013/0028797 A1 * 1/2013 Engelhard ..... 422/121

* cited by examiner

*Primary Examiner* — Robert G Santos
*Assistant Examiner* — Myles Throop
(74) *Attorney, Agent, or Firm* — David L. King

(57) ABSTRACT

An apparatus for caring for infants, having, an infant body support structure, an air nozzles mounted on infant body support structure, and located at the end or sides of infant body support structure, above the space designated to the head of the infant, to provide an air flow of disinfected air parallel to a part of the bottom designated to support the back and the head of the infant, to protect the infant from airborne infections.

9 Claims, 5 Drawing Sheets

APPARATUS FOR CARING FOR INFANTS

FIELD OF THE INVENTION

This invention relates to patient care apparatus, and particularly to apparatus for caring for infants. More particularly, the present disclosure relates to cribs and bouncers for caring for infants. Most particular the present disclosure relates to cribs and bouncers for caring for premature infants, and special needs infants.

BACKGROUND OF THE INVENTION

Premature born or ill infant is spending significant time after his or her birth in sophisticated patient care apparatus in a hospital. Patient care apparatus, such as incubators, are used to provide a special, tightly controlled environment for premature infants in the hospital. An incubator for an infant provides conditions for special care and protects the infant from infections. The U.S. Pat. No. 3,610,716 describes an isolator crib bank having a module for filtering air delivered to ganged cribs for neonates. This invention teaches an isolator crib bank for use in the hospital. The isolator crib bank is bulky, energy consuming and can be used only in hospital environment. After releasing from the hospital premature infants may require special care because they are very sensitive to infections and very often experienced serious, life threatening complications after contracting respiratory infections.

Conventional apparatus for caring for infants after releasing from the hospital provide support for infant body, and means for preventing an infant, from falling out. Among these conventional apparatuses for caring for infants are different types of cribs and bouncers. There are number of apparatus for caring for infants, such as cribs, and bouncers which provide safe and comfortable positioning of the infant. The U.S. Pat. No. 5,787,534 discloses a safety pad or mattress such as for use in a crib, which prevents sudden infant death syndrome by ensuring an oxygenated breathing space for the infant. According to this patent, an embedded air tube is interconnected with an air pump which circulates fresh, i.e., oxygenated, air in the breathing space of the infant. While the U.S. Pat. No. 5,787,534 teaches a pad or a mattress which prevents sudden infant dead syndrome, it does not teach a prevention of an infant from disease contracted from airborne infections.

The U.S. Pat. No. 7,404,219 discloses portable infant bed with side wall ventilation. The side wall has a vent positioned at a level near the sleeping surface, the vent permitting air to pass freely through the side wall. While the U.S. Pat. No. 7,404,219 teaches an infant bed with improved passage of air across the child sleeping surface, it does not teach an infant bed protecting an infant from airborne infections.

These conventional apparatus for caring for infants, where the infant spends most of his or her time, lack of means for protection of the infant from contracting respiratory infections.

There are a number of means which reduce risk of contracting of airborne infection in adults. Among these means are different types of masks and protective gear. The U.S. Pat. Nos. 6,941,949; 6,945,249; 4,488,547 disclosed the examples of face masks.

The disadvantage of known protective masks and protective gear is that they cannot be used in infants because they have resistance to breathing, create uncomfortable feeling, sense of isolation from the environment, and could be dangerous to infants.

None of the above inventions and patents, taken either singly or in combination, is seen to teach the apparatus for caring for infants preventing from contracting respiratory infections.

Accordingly, there is presently a need for an apparatus for caring for infants that reduces or eliminates some of the risks associated with respiratory infections.

The present invention has been developed in response to the problems and needs in the present state of art that have not yet been solved by currently available apparatus for caring for infants. Accordingly, the present invention has been developed to provide an apparatus for caring for infants protecting an infant from airborne infections.

SUMMARY OF THE INVENTION

An apparatus for caring for infants which is used for caring for the infant at home or during visits of doctor's offices, public places or private homes.

The apparatus includes an infant body support structure, with a bottom, high ends, side guard means, air nozzles, a chamber, a fluid communication means, fan means, an ultraviolet light emitter, and a filter means in said chamber to provide filtering the air through said filter means. The apparatus also includes an energizing means, to provide the energy supply for said ultraviolet light emitter and for said fan means.

The air nozzles preferably mounted on the infant body support structure. The air nozzles located at the end of the infant body support structure supporting the head of the infant, above the head of the infant. The air nozzles have at least one nozzle. The air nozzles provide an air flow of disinfected air. The air flow of disinfected air protects the infant from airborne infections.

The chamber is mounted preferably under the bottom of the infant body support structure. The chamber has an air inlet at one end and an air outlet at the opposite end.

The fluid communication means preferably has at least one air duct. The fluid communication means connected with the air outlet of the chamber at one end and with the air nozzles at another end.

The fan means preferably disposed at the chamber to generate the air flow through the chamber, fluid communication means, and the air nozzles.

The ultraviolet light emitter mounted at the chamber to produce germicidal means for killing microorganisms in the air flow.

The filter means preferably disposed at the chamber to provide filtering the air through the filter means.

The energizing means preferably provide electric energy for the ultraviolet light emitter and for the fan means.

Preferably the apparatus for caring for infants has air nozzles located above the head of the infant. The air nozzles providing the air flow of disinfected air parallel to the part of the bottom supporting the back and the head of the infant.

Preferably the apparatus for caring for infants has air nozzles disposed at opposite sides of the side guard means and facing each other.

Preferably the apparatus for caring for infants has air nozzles located behind of a head of the infant.

Preferably the apparatus for caring for infants recited in claim 1 wherein, an axis of the air flow coming from the air nozzles is parallel to the part of the bottom supporting the back of the infant and a head of the infant.

Preferably the apparatus for caring for infants has an ultraviolet lamp which emits ultraviolet germicidal radiation and irradiating the air passing the chamber.

Preferably the apparatus for caring for infants has light emitting diodes emitting germicidal ultraviolet radiation and irradiating the air passing the chamber.

Preferably the apparatus for caring for infants has the ultraviolet lamp enclosed in a substantially parabolic reflector, the reflector having an aperture for passing filtered air towards the lamp.

Preferably the apparatus for caring for infants has the ultraviolet lamp enclosed in the substantially parabolic reflector producing substantially collimated germicidal beams.

Preferably the apparatus for caring for infants has ultraviolet emitter situated at the inlet end of the chamber. The ultraviolet emitter emits germicidal beams towards the outlet end of the chamber.

Preferably the apparatus for caring for infants has ultraviolet light emitter situated at one sidewall of the chamber. The ultraviolet emitter emits germicidal beams towards other sidewall of the chamber.

Preferably the apparatus for caring for infants has the ultraviolet light emitter situated coaxially with a long axis of the chamber.

Preferably the apparatus for caring for infants has the energizing means. Preferably the energizing means is the electricity coming from electrical wiring of a room to energize the ultraviolet emitter and fan means. Preferably the apparatus for caring for infants electrically connected with electrical wiring of the room by flexible cord.

Preferably the apparatus for caring for infants has a battery located at the infant body support structure. Preferably the battery electrically connected with the ultraviolet emitter and fan means. The battery provides the electricity to energize the ultraviolet emitter and fan means.

BRIEF DESCRIPTION OF THE DRAWINGS

The invention will be described by way of example and with reference to the accompanying drawings in which.

DETAILED DESCRIPTION OF THE INVENTION

Figure 1:
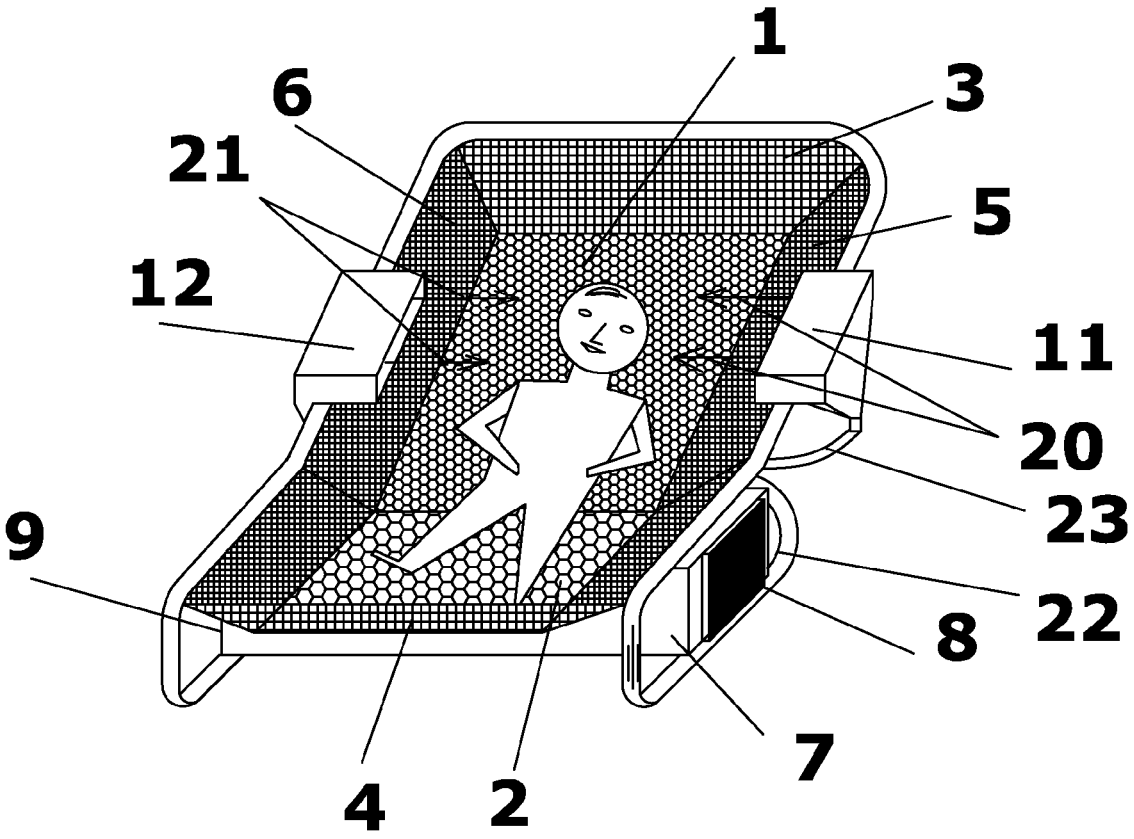
FIG. 1 is a schematic view of a preferred embodiment of the invention showing a bouncer as an apparatus for caring for infants with air nozzles disposed at opposite sides of the side guard means and facing each other.
Figure 2:
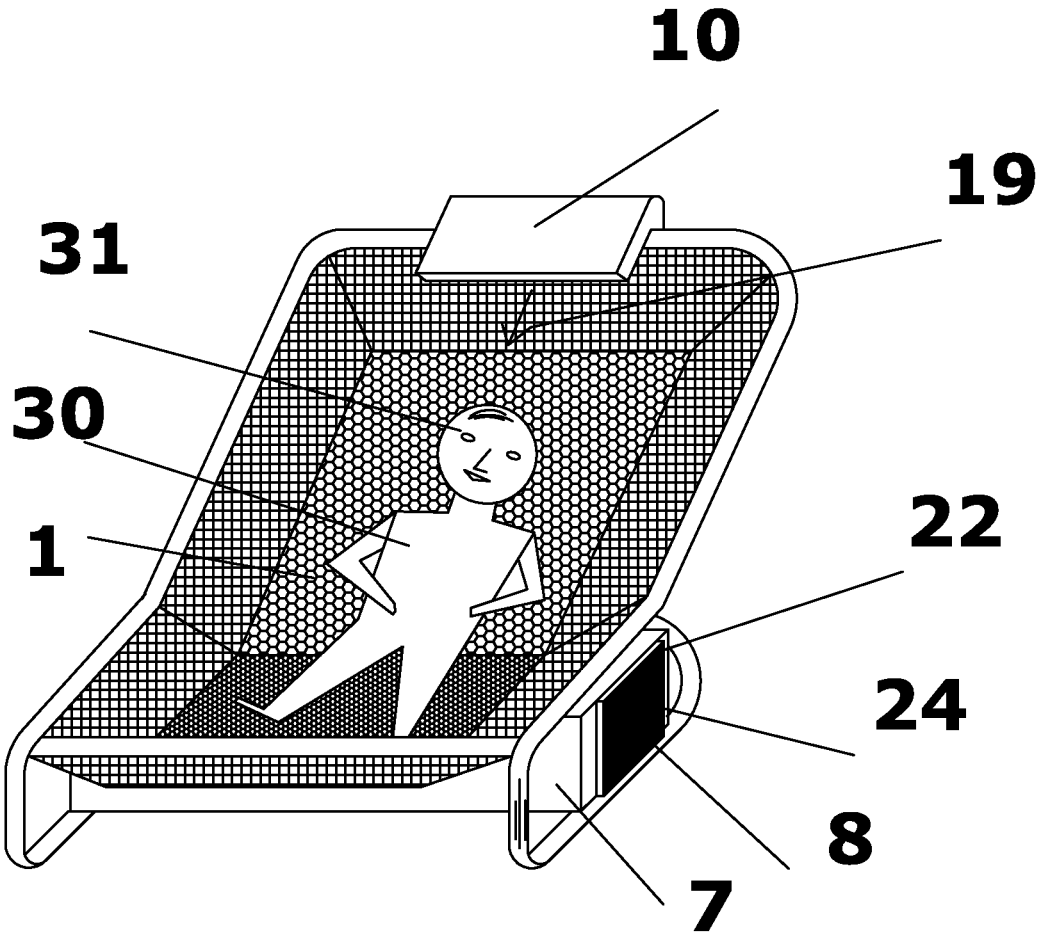
FIG. 2 is a schematic view of a preferred embodiment of the invention showing a bouncer as an apparatus for caring for infants with air nozzles located behind of a head of the infant.
Figure 3:
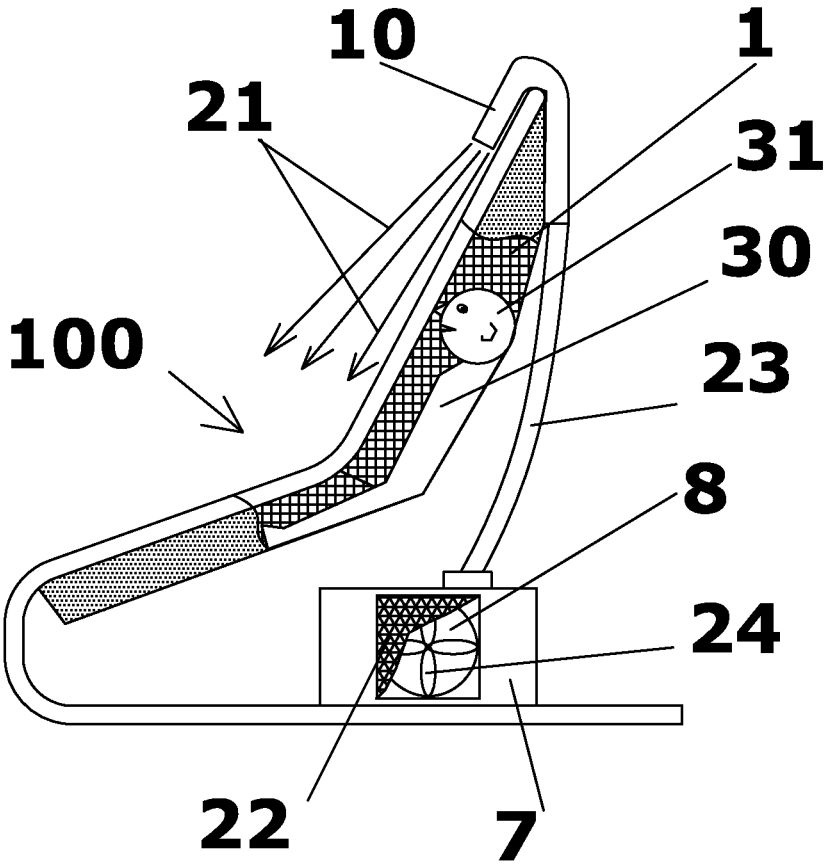
FIG. 3 is a schematic side view of a preferred embodiment of the invention showing a bouncer as an apparatus for caring for infants with air nozzles located behind of a head of the infant.
Figure 4:
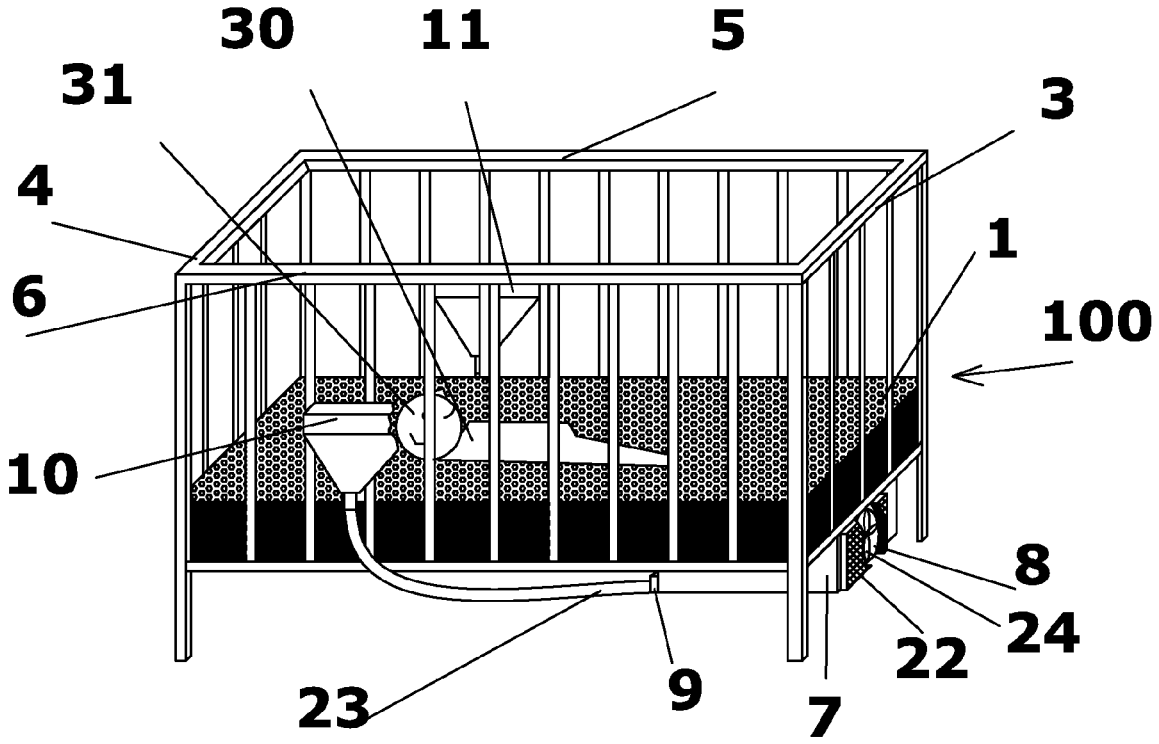
FIG. 4 is a schematic view of a preferred embodiment of the invention showing a crib as the apparatus for caring for infants and all its components.
Figure 5:
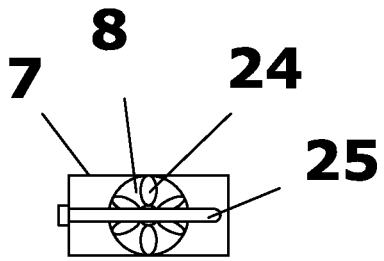
FIG. 5 is a schematic view of a preferred embodiment of the invention showing a cross sectional view of a chamber and its components wherein the ultraviolet light emitter is situated at the inlet end of the chamber and emits germicidal beams towards the outlet end of the chamber.
Figure 6:
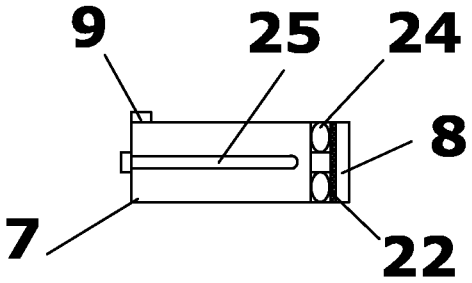
FIG. 6 is a schematic view of a preferred embodiment of the invention showing a cross sectional view of the chamber and its components wherein, the ultraviolet light emitter is situated coaxially with a long axis of the chamber.
Figure 7:
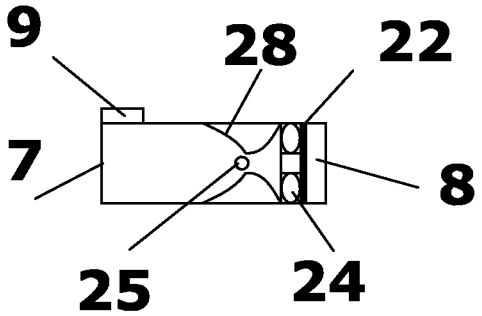
FIG. 7 is a schematic view of a preferred embodiment of the invention showing a cross sectional view of the chamber and its components wherein the ultraviolet lamp enclosed in a substantially parabolic reflector, the reflector having an aperture for passing filtered air towards the lamp.

The present invention provides an apparatus for caring for an infant, generally referred to by reference 100. The preferred embodiment of the invention is shown in FIG. 1-FIG. 7.

The apparatus for caring for an infant 100, includes, the infant body support structure, with the bottom 1, 2, high ends 3, 4, side guard means 5, 6. The air nozzles 10, 11, and 12 mounted on the infant body support structure and located at the end of the infant body support structure supporting the head 31 of the infant 30. The air nozzles 10, 11, and 12 located above the head 31 of the infant 30, and provide the air flow 20, 21 of disinfected air. The air flow 20, 21 of disinfected air is parallel to the part of the bottom 1 supporting the back and the head 31 of the infant 30. The chamber 7 is mounted at the lower part of the infant body support structure. The chamber 7 has the air inlet 8 at one end and the air outlet 9 at the opposite end.

The fluid communication means 23 connects the air outlet 9 of the chamber 7 at one end with the air nozzles 10, 11, 12 at the another end. The fan means 24 is mounted at the chamber 7, and generates air flow through the chamber 7.

According to the preferred embodiment the ultraviolet light emitter 25 is mounted at the chamber 7 to produce germicidal means for killing microorganisms in the air flowing through the chamber 7.

The filter means 22 is located at the inlet opening 8 of the chamber 7. The filter means 22 provides filtering the air flow, entering the chamber 7.

The energizing means provide the energy for the ultraviolet light emitter 25, and for the fan means 24.

According to the preferred embodiment the air nozzles 11, 12 disposed at opposite sides of the side guard means 5, 6 above of a head 31 of the infant 30, and facing each other.

According to another preferred embodiment the air nozzles 10 located behind and above of a head 31 of the infant 30.

According to the preferred embodiment, the axes of the air flows 19, 20, 21 coming from the nozzles 10, 11, 12 are parallel to a part of the bottom 1 supporting the back of the infant and the head 31 of the infant 30.

According to the preferred embodiment the ultraviolet light emitter 25 includes the ultraviolet lamp.

According to another preferred embodiment ultraviolet light emitter includes the light emitting diode.

According to the preferred embodiment the ultraviolet light emitter 25 enclosed in a substantially parabolic reflector 28, the reflector having an aperture for passing filtered air towards the ultraviolet light emitter.

According to the preferred embodiment the germicidal means for killing microorganisms in the air flow include substantially collimated germicidal beams.

Preferably the ultraviolet light emitter 25 is situated at the inlet end of the chamber 7 and emits germicidal beams towards the outlet end of the chamber 7.

Preferably the ultraviolet light emitter 25 is situated at the one sidewall of the chamber 7 and emits the germicidal beams towards the other sidewall of the chamber 7.

Preferably the ultraviolet light emitter 25 is situated coaxially with the long axis of the chamber 7.

Preferably the energizing means has the electricity coming from electrical wiring of the room. A flexible electrical cord 26 (not shown) connects electrical wiring of the room with the fan means 24 and the ultraviolet emitter 25. The electricity powers the fan means 24, and the ultraviolet emitter 25. The ultraviolet emitter 25 produces and sends germicidal beams to irradiate the air flow inside of the chamber 7 to kill infections viruses and bacteria. The fan means 24 moves the air flow through the filter means 22, the chamber 7, fluid communication means 23, and air nozzles 10, 11, 12.

According to another preferred embodiment the energizing means has the electricity from a battery 27 (not shown). The battery 27 located at the infant body support structure. The battery 27 is connected with the fan means 24 and the ultraviolet emitter 25 by electrical wires. The electricity powers the fan means 24, and the ultraviolet emitter 25. The fan means 24 moves the air flow through the filter means 22, the chamber 7, fluid communication means 23, and air nozzles 10, 11, 12. The ultraviolet 25 emitter produces and sends germicidal beams to irradiate the air flow inside of the chamber 7 and to kill infections viruses and bacteria.

In the present invention an apparatus for caring for infants provides a protection for the infant from respiratory infections. The protection for the infant 30 disposed on the bottom 1, 2 of the infant body support structure may be reached by providing of the air flow 19, 20, and 21 of infections free air into breathing zone of the infant.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described which will be within the full intended scope of the invention as defined by the following appended claims.

What is claimed is:

1. An apparatus for caring for infants, comprising:

an infant body support structure, the infant body support structure having a bottom, two ends and two sides, the two ends having one being a head end and the two sides extend between the ends to form side guards;

two or more air nozzles mounted on said infant body support structure, wherein the nozzles are located at the head end or on the side or sides, above the bottom of said infant body support structure at a location for supporting the head of the infant and the nozzles are configured to provide an air flow of disinfected air parallel to a part of the bottom at the location for supporting the back and the head of the infant, the disinfected air flowing directly above the location for the head to protect the infant from airborne infections for providing the disinfected or infection free air into a breathing zone of the infant;

a chamber adapted to be mounted on said infant body support structure, the chamber having an air inlet at one end and an air outlet at the opposite end for receiving air at the air inlet to be disinfected and passing the disinfected air through the outlet;

a fluid communication means, being at least one air duct connected with the air outlet of the chamber at one end and with the two or more air nozzles at the another end to provide the disinfected air flow;

a fan means disposed at the air inlet of the chamber to generate an air flow through the chamber;

an ultraviolet light emitter situated at the air inlet of the chamber inside the chamber at a sidewall of the chamber to produce germicidal beams for killing microorganisms emitted toward an opposite sidewall towards the air outlet end of the chamber irradiating all of the air in the air flow to create the disinfected air;

a filter means located at the air inlet filtering the air flow entering in the chamber to provide filtering of all the air in the air flow through the filter means;

an energizing means, to provide the energy for said ultraviolet light emitter and for the fan means;

wherein the fan means moves the air flow through the filter means of the chamber, the at least one air duct of the fluid communication means and the air nozzles as the ultraviolet emitter produces and sends germicidal beams to irradiate all of the air flow inside the chamber;

wherein the two or more air nozzles are disposed at opposite sides, one nozzle on each opposed side above the location for the head of the infant and facing each other to direct one parallel air flow of disinfected air toward the other; and wherein the ultraviolet light emitter is enclosed in a substantially parabolic reflector, the reflector having an aperture for passing filtered air towards the ultraviolet light emitter.

2. The apparatus for caring for infant recited in claim 1 wherein, one of the air nozzles is located at the head end behind and above the location for the head of the infant.

3. The apparatus for caring for infant recited in claim 1 wherein, an axis of the air flow from said nozzles is parallel to a part of the bottom supporting of the back of the infant and a head of the infant.

4. The apparatus for caring for infant, recited in claim 1 wherein the ultraviolet light emitter is ultraviolet lamp.

5. The apparatus for caring for infant recited in claim 1 wherein ultraviolet light emitter is light emitting diode.

6. The apparatus for caring for infants recited in claim 1 wherein the germicidal beams for killing microorganisms in the air flow are substantially collimated germicidal beams.

7. The apparatus for caring for infant recited in claim 1 wherein, said ultraviolet light emitter is situated coaxially with a long axis of said chamber.

8. The apparatus for caring for infant recited in claim 1 wherein, the energizing means is the electricity coming from electrical wiring of the room.

9. The apparatus for caring for infant recited in claim 1 wherein, the energizing means is the electricity from a battery located at said infant body support structure.

* * * * *